US005221222A

United States Patent [19]

Townes

[11] Patent Number: 5,221,222

[45] Date of Patent: Jun. 22, 1993

[54] NOVELTY SLEEVE DEPICTING A MUSCULAR ARM

[75] Inventor: William H. Townes, Chesapeake, Va.

[73] Assignees: Chris A. Becker, Kenosha, Wis.; Stanley E. Buhrow, Gurnee, Ill. ; part interest to each

[21] Appl. No.: 915,262

[22] Filed: Jul. 20, 1992

[51] Int. Cl.[5] ..... A63H 33/00

[52] U.S. Cl. ..... 446/26; 2/59; 446/390

[58] Field of Search ..... 2/16, 59, 126; D2/615, D2/79, 80, 610, 29, 225; 602/3, 6, 20, 62, 901; 623/57, 58; 446/26, 320, 321, 390

[56] References Cited

U.S. PATENT DOCUMENTS

| | | | |
|---|---|---|---|
| D. 249,400 | 9/1978 | Pearson . | |
| 814,795 | 3/1906 | Myers | 602/6 |
| 1,299,505 | 4/1919 | Petron | 623/58 X |
| 2,045,157 | 6/1936 | Mathias | 2/16 |
| 2,332,141 | 10/1943 | Greene . | |
| 2,657,394 | 11/1953 | Milton et al. | 623/57 |
| 2,727,278 | 12/1955 | Thompson . | |
| 4,280,292 | 7/1981 | Hills . | |
| 4,310,927 | 1/1982 | DeBose . | |
| 4,757,555 | 7/1988 | Gold . | |
| 4,951,317 | 8/1990 | Gray . | |
| 4,964,827 | 10/1990 | Rudy . | |
| 5,133,775 | 7/1992 | Chen | 2/16 X |

*Primary Examiner*—Danton D. DeMille

*Attorney, Agent, or Firm*—Arthur J. Hansmann

[57] ABSTRACT

A novelty sleeve for simulating a muscular arm and having an elongated opening through the sleeve for a person to slip the arm into the sleeve, and the sleeve has enlarged portions therealong for depicting enlarged arm muscles.

13 Claims, 3 Drawing Sheets

NOVELTY SLEEVE DEPICTING A MUSCULAR ARM

This invention relates to a novelty sleeve depicting a muscular arm. More particularly, it relates to a sleeve which a person can slide onto his or her arm to depict large arm muscles.

BACKGROUND OF THE INVENTION

The prior art is already aware of persons' garments which can be worn to enhance certain portions of one's body by way of enlargement. Those prior art items can be arranged to simply be padded, inflated, or manufactured so that their overall thickness is arranged to enhance the size of a person's body part. An example of the latter is shown in U.S. Pat. No. 249,400, although that patent does not completely disclose the aforementioned, and that is because the design patent is not showing sufficient details.

The present invention improves upon the prior art clothing and novelty items in the broad sense of providing a sleeve for a person's arm and wherein the sleeve is configurated to show enlarged arm muscles, particularly the bicep muscle. Further, the sleeve of this invention is made of an elastic and flexible material which will readily and easily slide onto a person's arm and which will flex with the normal bending of a person's elbow and movement of the arm from the shoulder. In accomplishing this, the novelty sleeve of this invention is arranged with both material and inner opening size such that it will snugly fit a person's arm and remain in position until it is intentionally pulled off the arm.

Still further, the present invention provides a novelty sleeve which can be readily presented both in a muscular arm configuration and in a coloration which will adapt to the natural color of a person's skin, whether it be white, black, brown, tan, pink, or the like.

Still further, the novelty sleeve of this invention adapts itself to be manufactured in a molding process but without any seams therealong and without any fasteners or the like. Instead, the sleeve is simply flexible and expandable so that it can be slipped onto a person's arm, and of course the girth and length of the sleeve can be made in various sizes to accommodate small children and grown adults in their respective natural arm sizes.

As such, the novelty sleeve of this invention can be used simply to accentuate a person's arm muscles, worn as a costume, or as protective gear such as in martial arts training use, or it can be arranged to fit over the normal cast on a person's arm for holding a broken arm until healed.

The novelty muscle sleeve of this invention will securely remain in place on a person's arm and will not impede any normal movement of the arm, including any bending movement of the elbow or any swinging of the arm from the shoulder, and the sleeve of this invention does extend from a person's shoulder to a person's wrist, for the exaggerated and enhanced depiction of the normal muscles in a person's arm.

Still further, in the one-step mold process producing this arm, as mentioned above, the exterior surface of the arm is smooth and colored to simulate the appearance of human skin on the arm. As such, it has the appearance of a human arm and it is also easy to clean with soap and water.

DETAILED DESCRIPTION OF THE PREFERRED EMBODIMENT

Figure 2:
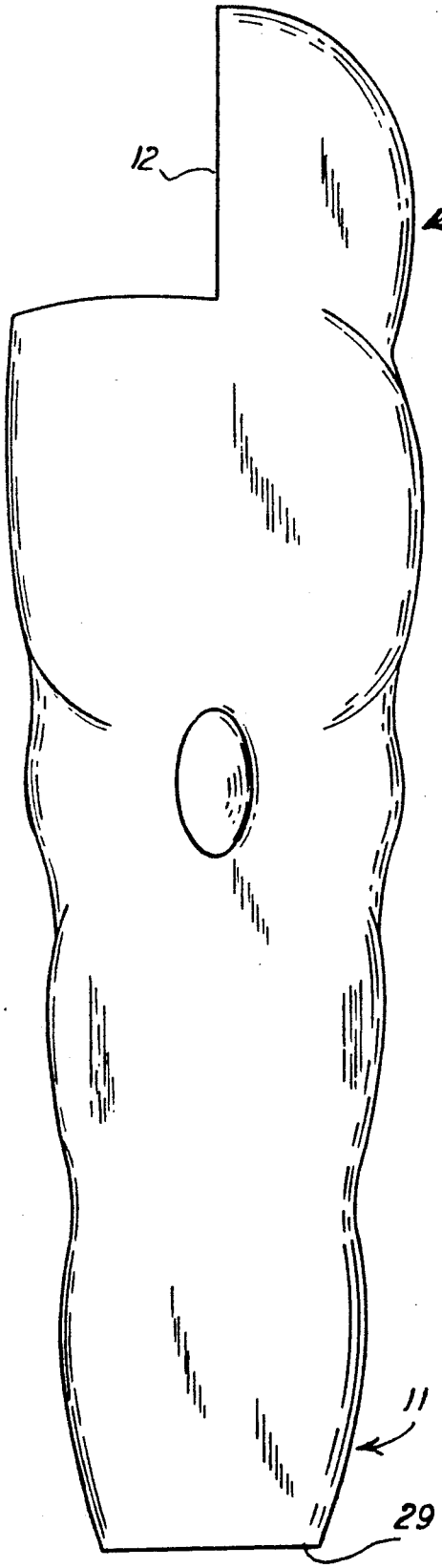
FIGS. 1 and 2 are right side and rear elevational views, respectively, of the right arm sleeve of this invention.
Figure 1:
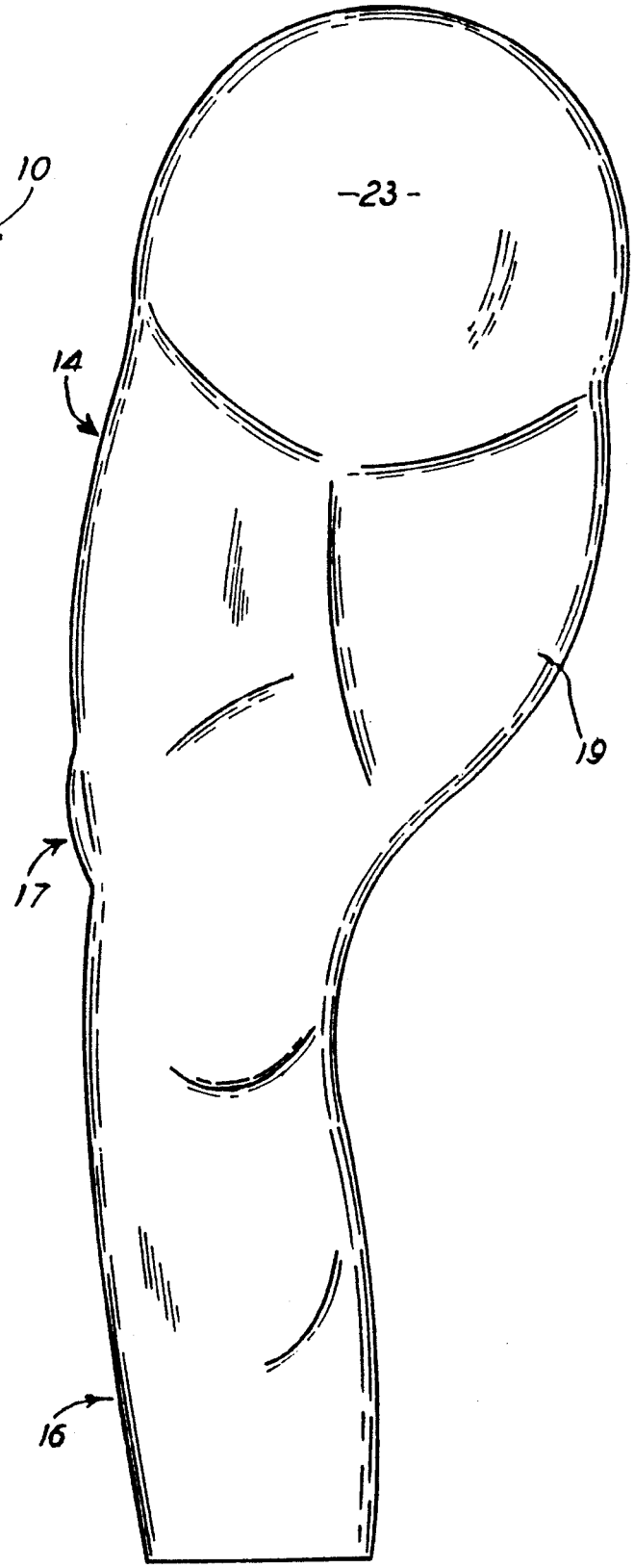

FIGS. 1 through 4 show elevational views of one embodiment of the sleeve of this invention and showing the enhanced muscles of a person's right arm. Of course there could also be a left arm sleeve. The sleeve itself extends longitudinally, along its entire length, from a shoulder portion, generally designated 10 and to a wrist portion, generally designated 11. The entire length of the sleeve from shoulder to wrist would be in conformance with that of a person's arm, whether it be a child or an adult, and thus the entire length of the sleeve could extend to at least approximately 40 inches, for instance. The upper end is the shoulder portion 10 which is shown to have an upstanding planar surface 12 and a generally horizontally extending planar surface 13, and the surfaces 12 and 13 are at right angles to each other, as shown. Of course it will also be seen and understood that the sleeve has an upper arm portion, generally designated 14 and a lower or forearm portion, generally designated 16, and the two portions are continuous and uninterrupted relative to each other and along the longitudinal length of the sleeve which is the upright showing of the sleeve. Still further, the drawings show the sleeve, such as in FIGS. 2 and 3, to be projected in elevational views perpendicular to the longitudinal axis of the lower or forearm portion 16. Also, the sleeve has the intermediate portion 17 which is the elbow portion of the novelty sleeve, as shown.

Figure 4:
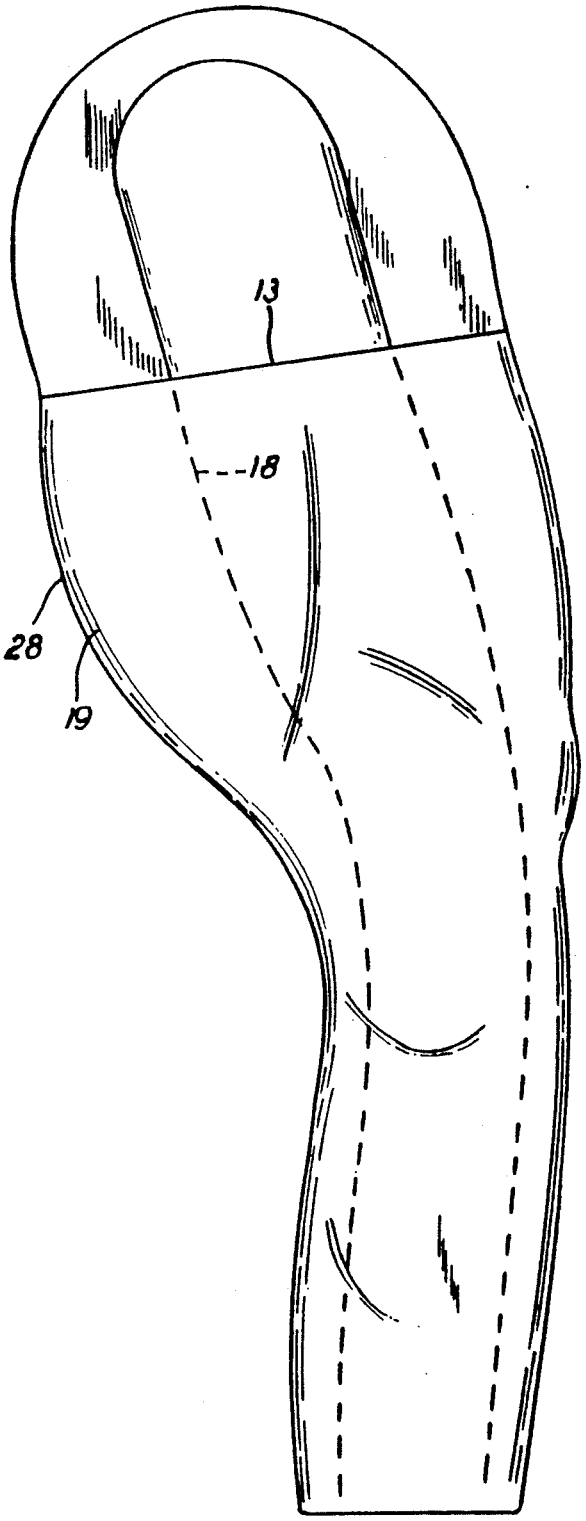

In its normal configuration, which is that shown in the drawings, there is therefore a slight angulation between the longitudinal axis of the forearm 16 and the longitudinal axis of the upper arm 14, such as shown in FIGS. 2 and 4. This, therefore presents the sleeve in a slightly bent original configuration, somewhat in the normal position of a person's arm which is not being held rigidly straight.

Figure 3:
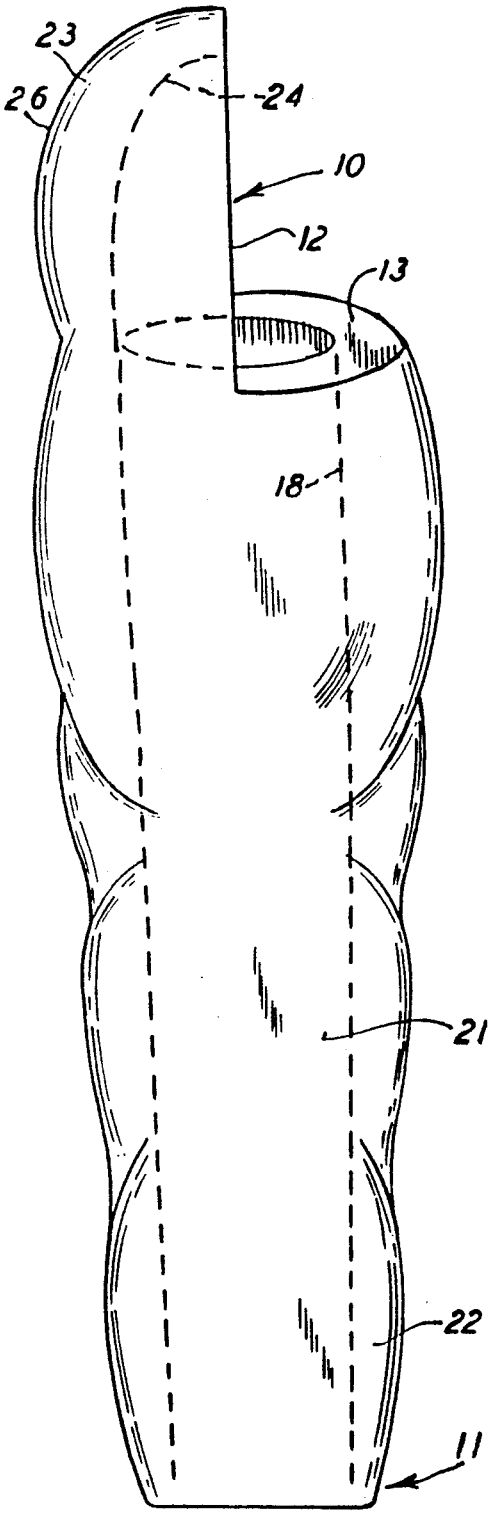
FIGS. 3 and 4 are the front and left side elevational views, respectively, of the arm shown in FIGS. 1 and 2.

It will therefore be understood that a person can slide the sleeve over the right arm, and the sleeve will extend from the person's shoulder to the person's wrist, and the person's arm will be snugly received by the longitudinal and generally circular cross-sectional opening 18 extending through the entire length of the sleeve, as shown in FIGS. 3 and 4 by the dotted lines. The cross-sectional extent of the opening 18 in the upper arm will be somewhat larger than the cross-sectional extent of the opening 18 in the forearm, and the sleeve will therefore again accommodate the normal person's arm.

The sleeve is made of a plastic material, preferably a polyurethane foam which is flexible, elastic, resilient, lightweight, washable, and is of like characteristics and is also washable. The sleeve is made in a seamless molding process so that the end product is that which is seen in these drawings when the sleeve is removed from the mold. To simulate a person's natural skin tone and color, the sleeve can be painted, or the mold material can be pigmented, or the mold itself can be spray painted so that the coating on the mold will adhere to the molten plastic material introduced into the mold. Also, with the use of the plastic and foamlike material, the sleeve will actually be receptive to ambient air to therefore have the sleeve dissipate body heat and be in the nature of breathing.

In the molding process, the central longitudinal opening 18 is formed, and the upper arm cross-sectional portion can be from approximately 3 to 7 inches, and the forearm cross-sectional portion can be from 1½ to 3 inches at the wrist or lower end.

As indicated in the drawings, the usual bicep muscle of a person's arm is enhanced by the bicep portion 19 of the sleeve, and it will be seen that at the bicep 19, the cross-sectional dimension of the opening 18 is only approximately one-half of the total cross-sectional dimension of the sleeve at the bicep 19. This, therefore results in an enhanced bicep muscle 19 for the wearer of this sleeve, and, in fact, the sleeve being a flexible and elastic material, when the wearer flexes his or her bicep muscle, then the sleeve itself will further expand at the bicep 19, much like the normal muscle expansion of an arm.

The sleeve will also be enlarged and thus exaggerate in depiction the wearer's brochiorodialis 21 which is normally the long and frontal muscle of the forearm. Further, the sleeve can enhance the size of the wearer's forearm abductor muscle 22, as well as other muscles along one's arm.

In addition to the enlarged bicep muscle 19, another important aspect of the sleeve is the shoulder portion 10 which presents an enlarged deltoid muscle portion 23. The enhancement of this upper shoulder muscle 23 presents the image of one having extremely muscular and thus powerful upper arms.

The wearer will slip the sleeve over the right arm, and the sleeve will be pulled on to a point where the surface 13 is positioned at the wearer's armpit, and the surface 12 is extending up and around the person's shoulder at the deltoid muscle area. Subsequently, the wearer can put on a T-shirt or any short-sleeved shirt which will extend to a point where it will extend just beyond the surfaces 12 and 13 to thereby conceal those surfaces and have the deltoid portion 23 and the bicep portion 19 extend beyond the hem of the short-sleeved shirt. To accommodate this, the sleeve also has the opening 24 extending through the upstanding shoulder portion 23 which is bounded by the planar surface 12 and the somewhat hemispherical surface 26.

Figure 5:
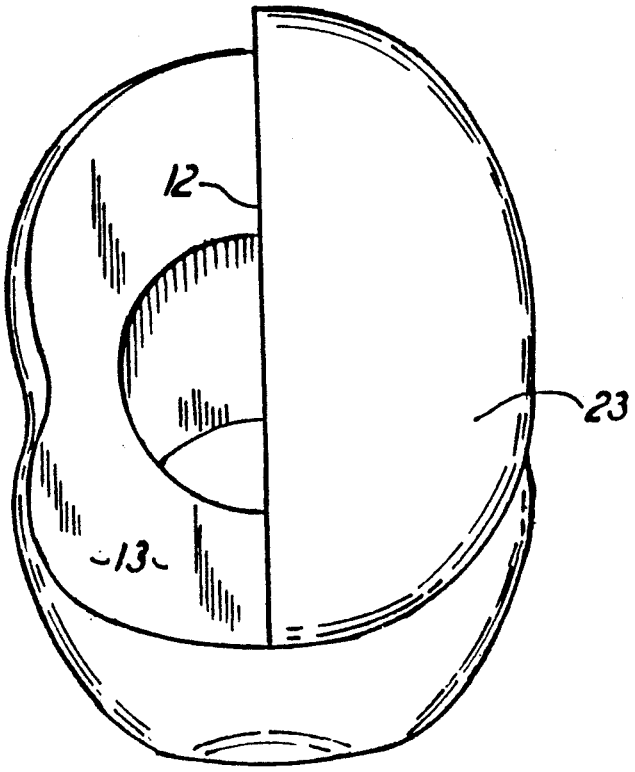
FIGS. 5 and 6 are top and bottom views, respectively, of the sleeve shown in FIGS. 1–4.
Figure 6:
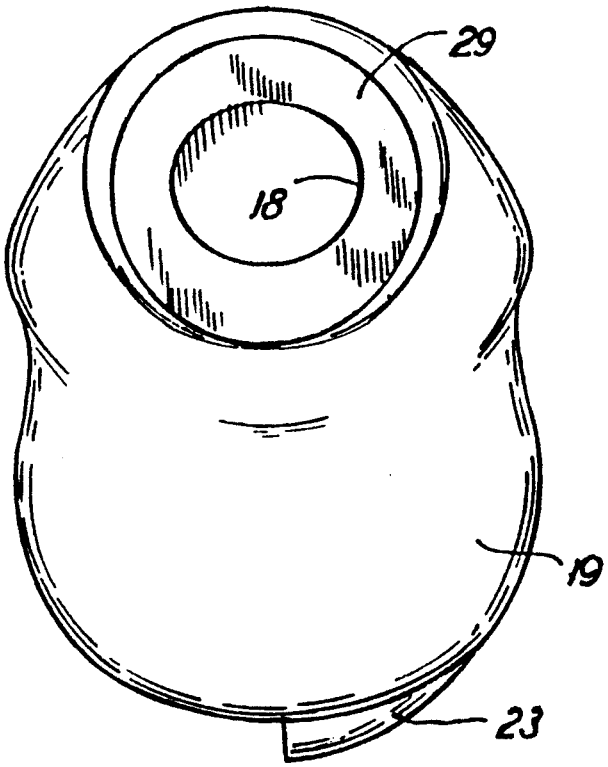

FIG. 5 shows the top view which is essentially looking down on the sleeve in line with the longitudinal axis of the opening 18 through the forearm 16. Also, FIG. 6 is a bottom plan view looking in line with the axis through the opening 18 in the forearm 16.

Figure 7:
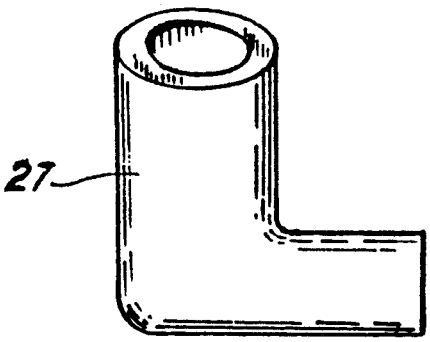
FIG. 7 is a reduced size view of a normal arm cast over which the sleeve of this invention can be positioned.

FIG. 7 shows, in reduced scale, what could be a normal medical cast for fitting on to the upper arm and forearm of a person for the purpose of setting the arm which had been broken. In that event, the novelty sleeve of this invention can be arranged in the material, process, shape, of that heretofore described so that it can be slid over the cast 27, at least generally shaped as shown in FIG. 7.

In this arrangement, the enhancement of the bicep muscle 17 is presented by virtue of the thickness of the plastic material in cross-section through the bicep 19 and from the opening 18 to the exterior or skin surface 28 of the bicep 19 and is at least one quarter of the smallest dimension across the opening 18 anywhere along the length of the sleeve, such as at the forearm portion 16. That is, the bicep 19 is indeed enhanced in size. It will further be seen and understood that the thickness of the sleeve material throughout the length of the sleeve varies along that length to thereby simulate the various arm muscles.

The sleeve is of a self-standing material, that is, it will not collapse like a normal shirt-sleeve or any other flexible material without body, and the sleeve is self-retaining on a person's arm and will bend with normal arm bending.

The lower end of the sleeve terminates in the wrist or cuff surface 29 and extends up the surface 13, and there is also the shoulder extension portion 23 extending upwardly beyond the armpit surface 13.

What is claimed is:

1. A novelty sleeve for simulating a muscular arm, comprising an elongated sleeve with a length equal to the length of a person's arm and being a one-piece construction and including a representative upper arm length and a representative lower arm length joined together by a representative elbow portion, said sleeve having an opening extending through the entire length thereof and being arranged to receive a person's arm when said sleeve is slipped onto a person's arm and being arranged to slip off a person's arm, said sleeve being arranged to completely and snugly enclose a person's arm from the person's shoulder to the person's wrist, said sleeve being constructed exclusively of only one flexible and elastic material and being self-retaining and snug on a person's arm and being bendable with normal bending of a person's arm, said sleeve being of a polyurethane foam material capable of self-standing and having configurations on the exterior thereof for simulating large muscles including an emphasized shoulder deltoid muscle, and the length of said sleeve is presented by a thickness of said sleeve material throughout said length of said sleeve, and wherein said thickness varies along said length of said sleeve with the largest thicknesses at the locations of the wearer's arm muscles to thereby simulate said arm muscles.

2. The novelty sleeve for simulating a muscular arm as claimed in claim 1, wherein the thickness of said sleeve material from said opening to said exterior thereof is of a thickness at least one-tenth the dimension across said opening.

3. The novelty sleeve for simulating a muscular arm as claimed in claim 1, wherein said sleeve is configurated with the enlarged thickness at said upper arm to present an emphasized bicep muscle.

4. The novelty sleeve for simulating a muscular arm as claimed in claim 1, wherein said sleeve opening is of a cross-sectional dimension sufficient to have said sleeve slip over a medically applied cast on a person's arm.

5. The novelty sleeve for simulating a muscular arm as claimed in claim 1, wherein said sleeve is of a continuous and seamless girth on the plane therethrough transverse to the length thereof.

6. The novelty sleeve for simulating a muscular arm as claimed in claim 1, wherein said sleeve includes a shoulder portion which extends over a person's deltoid muscle and said sleeve terminates longitudinally short of but adjacent said shoulder portion in a right angle configuration suitable for snug fitting adjacent a person's arm pit.

7. The novelty sleeve for simulating a muscular arm as claimed in claim 1, wherein said sleeve opening along the length thereof is in the shape of a person's arm for facilitating sliding onto a person's arm.

8. The novelty sleeve for simulating a muscular arm as claimed in claim 1, including an exterior surface on the entire exterior of said sleeve which is arranged to present an exterior surface having the appearance of human skin in flexibility, elasticity, and color.

9. The novelty sleeve for simulating a muscular arm as claimed in claim 1, wherein the thickness of said sleeve material from said opening to said exterior at said upper arm length of said sleeve is at least one-quarter of the smallest dimension across said opening anywhere along the length of said sleeve.

10. A novelty sleeve for simulating a muscular arm, and being adaptable to slide over a person's arm cast, comprising an elongated sleeve with a length equal to the length of a person's arm from shoulder to wrist and being a one-piece construction and including a representative upper arm length and a representative lower arm length joined together by a representative elbow portion, said sleeve having an opening extending through the entire length thereof and being arranged to receive a person's arm cast when said sleeve is slipped onto said cast, said sleeve being arranged to completely and snugly enclose said cast from the person's shoulder to the person's wrist and being arranged to slide off said cast, and including a shoulder portion which extends over a person's deltoid muscle and said sleeve terminates longitudinally short of but adjacent said shoulder portion in a right angle configuration suitable for snug fitting adjacent a person's arm pit, said sleeve being constructed of an elastic material for being self-retaining on said arm cast, said sleeve being of a material capable of self-standing and the length of said sleeve is presented by a thickness of said sleeve material throughout said length of said sleeve, and wherein said thickness varies along said length of said sleeve with the largest thicknesses at the locations of the wearer's muscles to thereby simulate said arm muscles.

11. The novelty sleeve for simulating a muscular arm as claimed in claim 10, wherein said sleeve is configurated at said upper arm to present an emphasized bicep muscle.

12. The novelty sleeve for simulating a muscular arm as claimed in claim 10, including an exterior surface on the entire exterior of said sleeve which is arranged to present an exterior surface having the appearance of human skin in flexibility, elasticity, and color.

13. The novelty sleeve for simulating a muscular arm as claimed in claim 10, wherein said sleeve opening along the length thereof is shaped to be in the shape of said cast for facilitating sliding onto said cast.

* * * * *